US006243919B1

(12) United States Patent
Hetland

(10) Patent No.: US 6,243,919 B1
(45) Date of Patent: Jun. 12, 2001

(54) HINGE, ESPECIALLY FOR DOORS OR WINDOWS

(75) Inventor: Ove Hetland, Egersund (NO)

(73) Assignee: Safelock (NO)

( * ) Notice: Subject to any disclaimer, the term of this patent is extended or adjusted under 35 U.S.C. 154(b) by 0 days.

(21) Appl. No.: 09/269,995

(22) PCT Filed: Oct. 14, 1997

(86) PCT No.: PCT/NO97/00276

§ 371 Date: Jun. 14, 1999

§ 102(e) Date: Jun. 14, 1999

(87) PCT Pub. No.: WO98/16708

PCT Pub. Date: Apr. 23, 1998

(30) Foreign Application Priority Data

Oct. 15, 1996 (NO) ..... 964394

(51) Int. Cl.[7] ..... E05D 11/10
(52) U.S. Cl. ..... 16/348; 16/360
(58) Field of Search ..... 16/348, 357, 360, 16/361; 49/383, 397

(56) References Cited

U.S. PATENT DOCUMENTS

| | | | | |
|---|---|---|---|---|
| 2,032,109 | | 3/1936 | Bolesky | 16/363 |
| 2,883,699 | | 4/1959 | Gross | 16/302 |
| 3,941,180 | * | 3/1976 | Thill | 49/383 X |
| 4,290,233 | * | 9/1981 | Hubbard | 49/383 |
| 5,265,954 | * | 11/1993 | Keil | 16/360 X |
| 5,359,812 | * | 11/1994 | Mayfield | 49/383 |
| 5,570,925 | | 11/1996 | Cohen | 16/362 |
| 5,778,601 | * | 7/1998 | Wu | 49/383 |

* cited by examiner

*Primary Examiner*—Anthony Knight
*Assistant Examiner*—Robert L. Pilaud
(74) *Attorney, Agent, or Firm*—Samuels, Gauthier & Stevens, LLP

(57) ABSTRACT

The present invention relates to a hinge for preventing injuries due to crushing, especially in doors and windows, comprising a first hinge leaf (4) for connection to the door leaf (1) or the window leaf, a second hinge leaf (5) for connection with the door or window frame (2) and a swivel joint (6) which connects the first and second hinge leaves (4, 5) to one another. Either the first or the second hinge leaf (4, 5) is equipped with one or more fingers (7) projecting substantially at right angles from the plane of the hinge leaf (4, 5), and adapted for axial sliding movement in an opening or slot (11) arranged for the finger (7) or each finger (7) in the frame (2) or the door leaf (1). When the door leaf or window leaf is brought towards the closed position, the finger (7), if it meets with a foreign object, will slide axially out of the opening or slot (11) and create a distance between the door or window frame (2) and the door or window leaf (1).

7 Claims, 4 Drawing Sheets

HINGE, ESPECIALLY FOR DOORS OR WINDOWS

BACKGROUND OF THE INVENTION

The present invention relates to a hinge for preventing injuries due to crushing, especially in doors or windows, comprising a first hinge leaf for connection to the door or window leaf, a second hinge leaf for connection to the door or window frame and a swivel joint connecting the first and second hinge leaves to each other.

Such hinges are known from U.S. Pat. No. 2,883,699 and the present applicant's own Ser. No.-166, 099. The former teaches a hinge where the hinge leaf which is secured to the door is equipped with an extra swivel joint. If a finger or the like comes between the door leaf and the door jamb or frame, the hinge leaf will "break" around this extra swivel joint. The distance between this extra swivel joint and the true swivel joint of the hinge is such that there is sufficient room for, e.g., a finger. To prevent the hinge from breaking around the extra swivel joint when the door is closed normally, i.e., when there is no foreign object between the door leaf and the door jamb, the extra swivel joint is equipped with a spring which causes the hinge leaf to be held flat. The spring must be of a certain strength if this is to be achieved. This means that the foreign object, e.g., the finger of a child, must overcome this spring force before the hinge leaf is "broken" about the extra swivel joint. Certainly, these forces exerted on the finger of child would not be of the same magnitude as with a door equipped with a conventional hinge. However, they would exert a disagreeable pressure on the finger. At worst, if a small child is involved, injury may also be sustained.

In addition, the extra swivel joint is relatively complex, and if the spring were to be damaged, the hinge would not function properly, and it would be difficult to close the door.

The applicant's own Ser. No.-166,099 teaches a very much better hinge structure. Here, two outer hinge leaves are fixedly connected to the frame and the door leaf respectively, between which outer hinge leaves there is pivotally connected an intermediate hinge leaf. The intermediate hinge leaf is connected to opposite edges of the outer hinge leaves. Only the lower hinge of the door is of this type, whilst the upper door hinge is of a conventional type. This means that normally the weight of the door will hold the intermediate hinge leaf in abutment with the outer hinge leaf which is secured to the door. If a foreign object comes between the door frame and the door leaf, the normally closed angle between the intermediate hinge leaf and the outer hinge leaf secured to the door will open.

However, it has been found that when a foreign object comes between the door leaf and the door frame, this hinge will easily bend. Moreover, the normally closed angle between the intermediate hinge leaf and the outer hinge leaf secured to the door could easily open, even when the door is in the open position.

SUMMARY OF THE INVENTION

With the present invention an attempt is made to provide a hinge for preventing injuries due to crushing, which does not interfere with the function of the door, but which at the same time functions as certain prevention against injuries due to crushing. This is achieved by the features disclosed in the characterising clause in claim 1 below. With the hinge of the present invention there is no extra joint, but the creation of the space between the door frame and the door leaf takes place by means of a sliding function. The sliding takes place preferably at right angles to the face of the door frame facing the door leaf, so that the crushing prevention function does not come into effect when the door is fully open.

BRIEF DESCRIPTION OF THE DRAWINGS

The present invention will be explained in more detail below with reference to the accompanying figures, wherein.

DETAILED DESCRIPTION OF THE INVENTION

Figure 1:
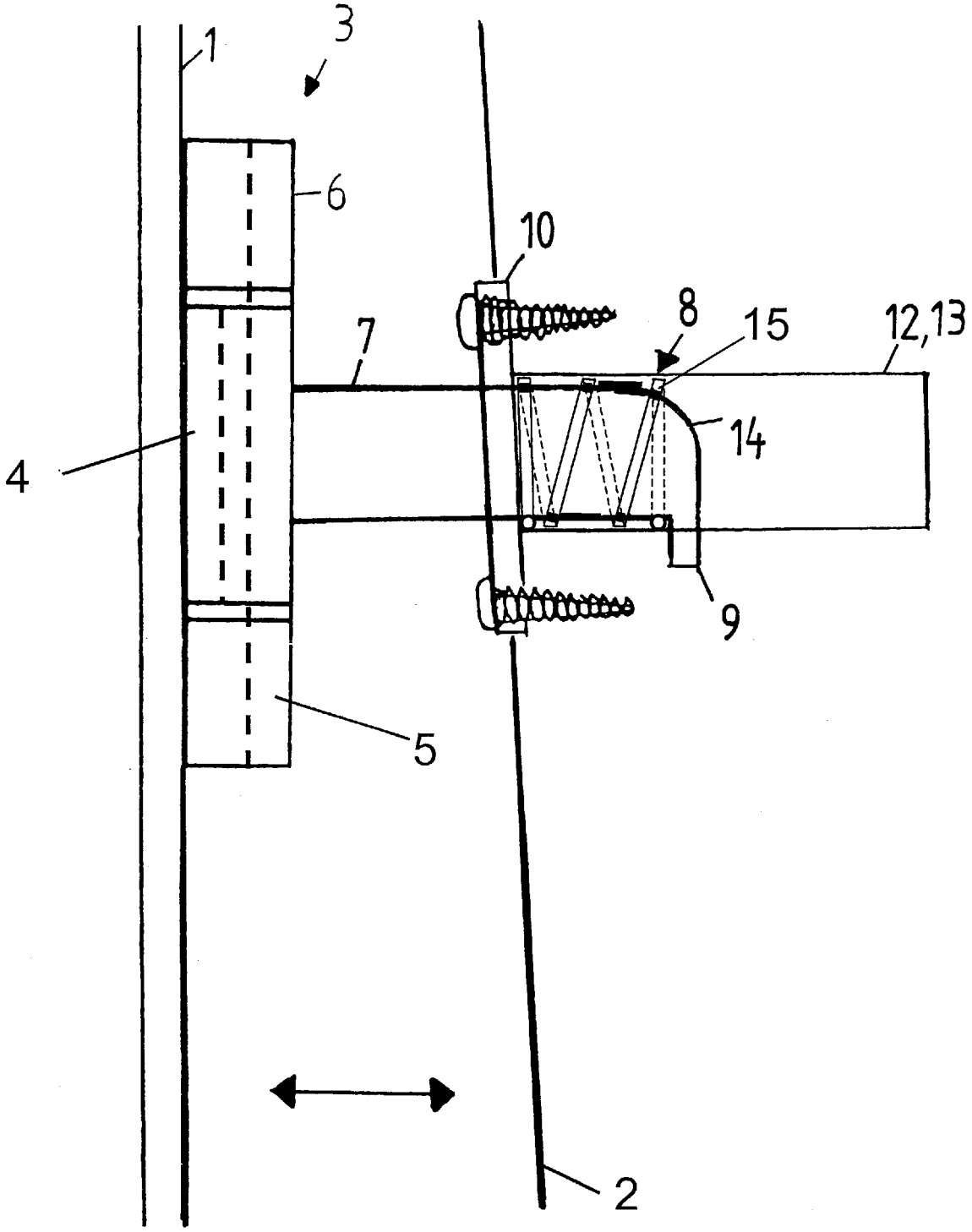
FIG. 1 is a sectional side view of a door equipped with a hinge in accordance with the invention.
Figure 2:
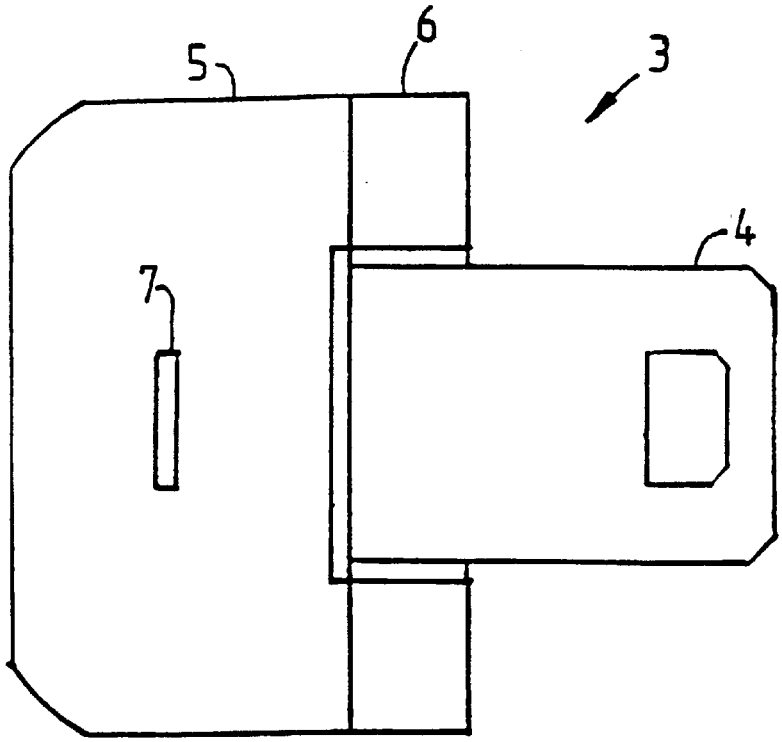
FIG. 2 is a plan view of a hinge in accordance with the invention.

FIG. 1 is a sectional view of a door leaf 1 and a door frame 2. Included in the section there is also a hinge 3 in accordance with a preferred embodiment of the invention. The door hinge 3 consists, as shown in FIG. 2, of a first hinge leaf 4, which is adapted for fixed connection to the door leaf 1, and a second hinge leaf 5, which is designed for interaction with the door frame 2. The hinge leaves 4 and 5 are connected to each other via a swivel joint 6. A finger 7, which is best shown in FIG. 1, projects from the hinge leaf 5 approximately at right angles to the face of the hinge leaf 5. The finger 7 is adapted for sliding guidance in an insert 8, which is recessed into the frame 2.

Figure 3:
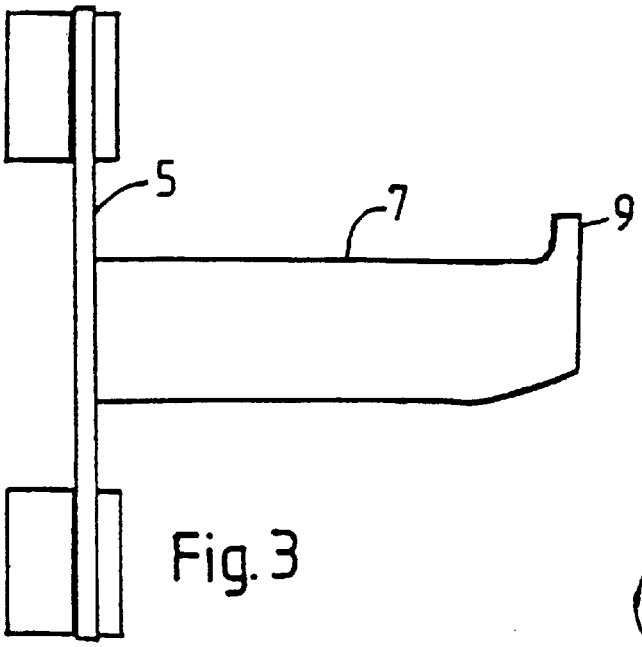
FIG. 3 is a lateral view of a hinge in accordance with the invention.
Figure 4:
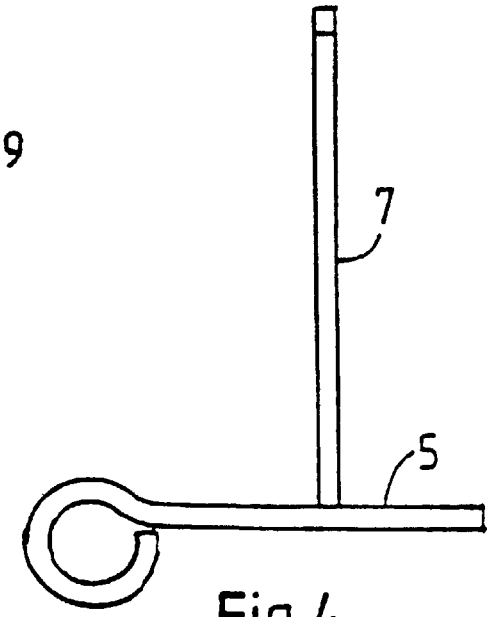
FIG. 4 shows the same hinge seen from above.
Figure 7:
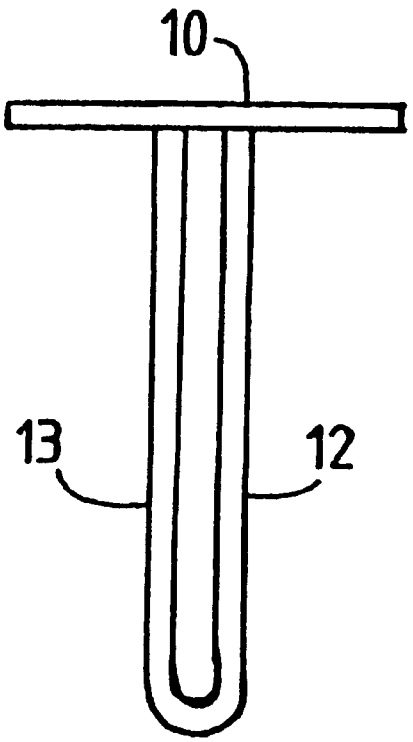
FIG. 7 shows the insert of FIG. 5 seen from above.
Figure 6:
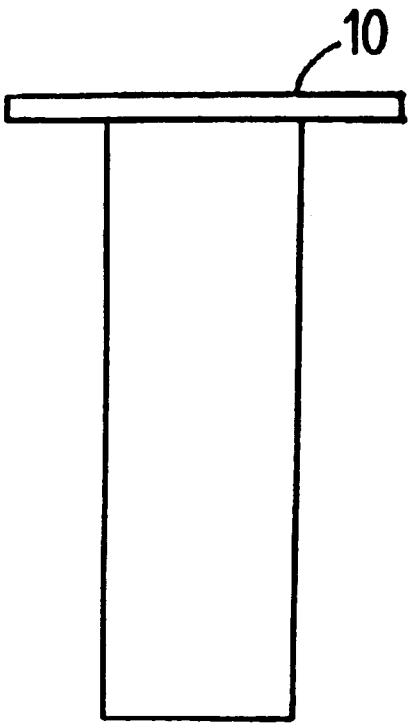
FIG. 6 is a lateral view of the insert according to FIG. 5.
Figure 5:
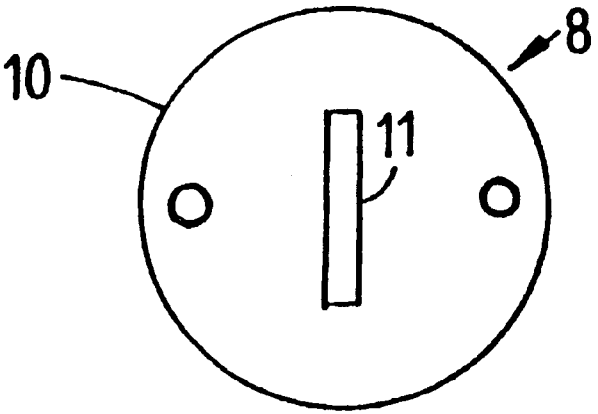
FIG. 5 is a plan view of an insert for sliding guidance in accordance with the invention.

The hinge leaf 5 with the finger 7 is also shown in FIGS. 3 and 4, respectively seen from the side and from above. On the finger 7 there is a stop 9, whose function will be explained in more detail below. The insert 8 is shown in plan view, lateral view and from above respectively in FIGS. 5, 6 and 7. The insert 8 consists of a cover plate 10, which, when the insert 8 is recessed into the frame 2, is substantially flush with the frame 2. A slot 11 is made in the cover plate 10. The slot 11 has a height and width which approximately corresponds to or preferably is slightly larger than the width and the height of the finger 7.

Flush with the slot 11 there are provided on the inside of the cover plate 10 two guide plates 12, 13. The guide plates are preferably connected to one another at their ends opposite the cover plate 10. The distance between the guide plates 12 and 13 corresponds to or is slightly greater than the width of the finger 7. The length of the guide plates 12, 13 corresponds to or is slightly greater than the length of the finger 7.

The hinge 3 is secured to the door frame 2 in that the finger is pushed in through the slot 11, stop 9 first. Opposite the stop 9 there is formed on the finger 7 a curved or chamfered portion 14 which enables the finger 7 to pass through the slot 11 with the stop 9. When the finger 7 has been passed fully into the insert 8, the door can be attached to the hinge leaf in a conventional manner.

Figure 1A:
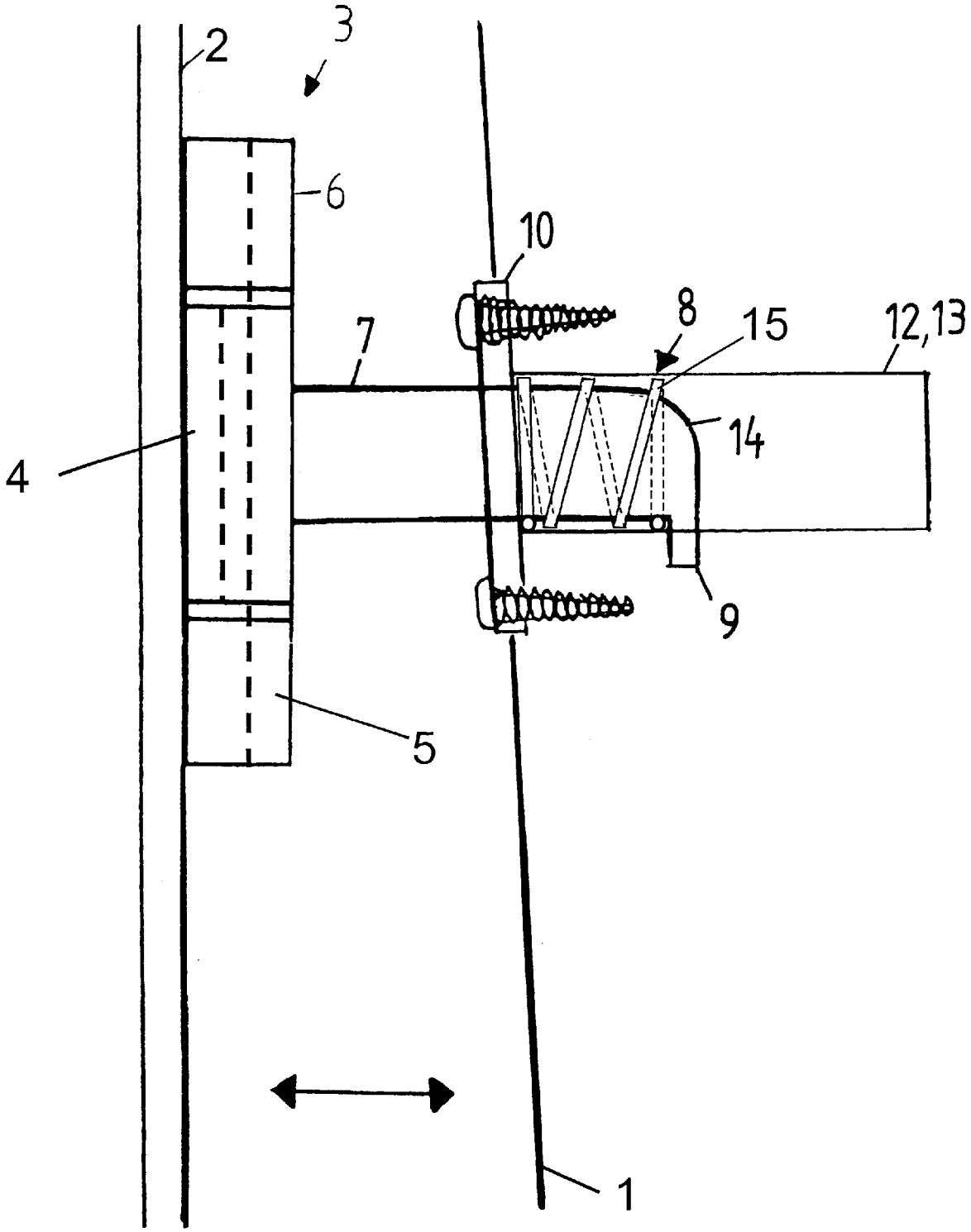
FIG. 1*a* is a sectional side view of a door equipped with a hinge in accordance with the invention, with the hinge mounted opposite of the hinge of FIG. 1.

In FIG. 1*a* the insert 8 is mounted in the door leaf 1 and the hinge leaf 4 is mounted on the door frame 2. The structure and the function of the hinge is exactly the same as in FIG. 1, thus the description of this is omitted. Although this way of mounting is unusual, this embodiment will also have the same advantages as the one shown in FIG. 1.

Only the bottom hinge is of the type mentioned above. The top hinge may be made in the same way as the top hinge in Ser. No.-166,099, where the hinge leaves of the top hinge are capable of being moved somewhat laterally relative to one another.

If a foreign object, e.g., the finger of a child, should come between the door leaf and the door frame when the door is closed, this will cause the finger 7 to be pulled out of the insert 8. The stop 9 prevents the finger 7 from being pulled all the way out of the insert 8, but the path of travel is so great that there is sufficient clearing for a finger as high up on the door as is natural for the finger of a child to be.

The door's own weight causes the finger to be kept fully in place inside the insert 8 during the normal function of the door. Since the finger 7 can only be pulled straight out of the insert 8, there will be no sideways movement of the door, and the door will feel firm and sound on the opening and closing movement, and will not have any tendency to be unsteady as with the previously known hinges.

There may optionally be provided a return spring which acts between the stop 9 and the cover plate 10. However, this spring 15 may be very weak, as normally the door leaf's own weight will hold the finger 7 in place inside the insert 8.

What is claimed is:

1. A hinge for preventing injuries due to crushing, especially in doors and windows, comprising:

a first hinge leaf for connection to the door leaf or the window leaf, a second hinge leaf for connection with the door frame or window frame, and a swivel joint which connects the first and second hinge leaves to one another, said first hinge leaf having a first side facing the door leaf or the window leaf and a second side facing the second hinge leaf, said second hinge leaf having a first side facing the second hinge leaf and a second side facing the second hinge leaf, wherein either the first or the second hinge leaf on said first side is equipped with one or more fingers projecting substantially at right angles from said first side of said first or second hinge leaf, at least one opening or slot defined in the door frame or window frame or door leaf or window leaf, said one or more fingers being adapted for axial sliding movement in said opening or slot, so that when the door leaf or window leaf is brought towards the closed position, the finger, if a foreign object is placed between the door frame or window frame and the door leaf or window leaf, will slide axially out of the opening or slot and create a distance between the door frame or window frame and the door leaf or window leaf.

2. The hinge according to claim 1, wherein the finger is an elongated plate-shaped element.

3. The hinge according to claim 1, wherein the opening or slot is made in an insert which is recessed in to the door or window frame or the door or window leaf.

4. The hinge according to claim 3, wherein the insert consists of two parallel plate-shaped guide parts, which at their outward facing ends are secured relative to one another by a cover plate, in which there is made a slot, and that the distance between the guide parts and the slot width in the cover plate is somewhat greater that the thickness of the finger.

5. The hinge according to claim 1, wherein on the outer end of the finger there is formed a stop which prevents it from sliding all the way out of the opening or slot.

6. The hinge according to claim 1, wherein in the opening there is provided a return spring which brings the finger back to its position inside the opening.

7. The use of the hinge according to claim 1, as the lower of two hinges on a door or window.

* * * * *